US012716596B2

(12) United States Patent
Nakano et al.

(10) Patent No.: US 12,716,596 B2
(45) Date of Patent: Aug. 25, 2026

(54) INDOOR UNIT AND AIR CONDITIONER

(71) Applicant: DAIKIN INDUSTRIES, LTD., Osaka (JP)

(72) Inventors: Hiroyuki Nakano, Osaka (JP); Shota Ago, Osaka (JP); Atsushi Yamamoto, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 96 days.

(21) Appl. No.: 18/619,959

(22) Filed: Mar. 28, 2024

(65) Prior Publication Data

US 2024/0240803 A1 Jul. 18, 2024

Related U.S. Application Data

(63) Continuation of application No. PCT/JP2022/018455, filed on Apr. 21, 2022.

(30) Foreign Application Priority Data

Sep. 30, 2021 (JP) ..... 2021-161746

(51) Int. Cl.
*F24F 1/0068* (2019.01)

(52) U.S. Cl.
CPC ..... *F24F 1/0068* (2019.02)

(58) Field of Classification Search
CPC .... F24F 1/0068; F24F 1/26; F24F 1/32; F24F 13/20; F24F 1/0059
See application file for complete search history.

(56) References Cited

FOREIGN PATENT DOCUMENTS

| | | | | |
|---|---|---|---|---|
| CN | 101236040 | A | * | 8/2008 |
| CN | 211041186 | U | * | 7/2020 |
| EP | 2620736 | A2 | | 7/2013 |
| EP | 3101353 | A1 | | 12/2016 |
| JP | H04-359797 | A | | 12/1992 |
| JP | H0684225 | U | * | 12/1994 |

(Continued)

OTHER PUBLICATIONS

International Preliminary Report on Patentability issued in International Application No. PCT/JP2022/018455, mailed Apr. 11, 2024 (6 pages).

(Continued)

*Primary Examiner* — Kun Kai Ma
(74) *Attorney, Agent, or Firm* — Osha Bergman Watanabe & Burton LLP

(57) ABSTRACT

An indoor unit includes a heat exchanger and a connection pipe, connected to the heat exchanger, through which a refrigerant flows. The connection pipe includes a first refrigerant pipe made of a first metal and a second refrigerant pipe made of a second metal higher in potential than the first metal. One end of the first refrigerant pipe is connected to the heat exchanger, and the other end of the first refrigerant pipe is connected to one end of the second refrigerant pipe. The first refrigerant pipe includes a vertical straight section, a bent section that is continuous with to a one end of the vertical straight section, and a horizontal straight section that is continuous with one end of the bent section. A covering member adheres to and covers the first refrigerant pipe from one end of the horizontal straight section to the bent section.

6 Claims, 10 Drawing Sheets

(56) References Cited

FOREIGN PATENT DOCUMENTS

| | | | | | |
|---|---|---|---|---|---|
| JP | 2000171054 | A | * | 6/2000 | |
| JP | 2005-262248 | A | | 9/2005 | |
| JP | 3139497 | U | * | 2/2008 | |
| JP | 2009138983 | A | * | 6/2009 | |
| JP | 2013-155892 | A | | 8/2013 | |
| JP | 2015-140998 | A | | 8/2015 | |
| WO | WO-2015155826 | A1 | * | 10/2015 | ..... F28F 19/02 |
| WO | WO-2021153043 | A1 | * | 8/2021 | ..... F25B 41/24 |

OTHER PUBLICATIONS

International Search Report issued in International Application No. PCT/JP2022/018455 mailed Jun. 21, 2022 (5 pages).
Written Opinion issued in International Application No. PCT/JP2022/018455 mailed Jun. 21, 2022 (4 pages).
Extended European Search Report issued in corresponding European Patent Application No. 22875434.7, dated Nov. 21, 2024 (10 pages).

* cited by examiner

INDOOR UNIT AND AIR CONDITIONER

CROSS REFERENCE TO RELATED APPLICATIONS

This application is a Continuation of PCT International Patent Application No. PCT/JP2022/018455, filed on Apr. 21, 2022, which claims priority under 35 U.S.C. § 119(a) to Japanese Patent Application No. 2021-161746, filed in Japan on Sep. 30, 2021. The contents of these applications are incorporated herein by reference in their entirety.

BACKGROUND

Technical Field

The present disclosure relates to an indoor unit and an air conditioner.

Discussion of the Background

Examples of a known indoor unit include an indoor unit constituting a part of an air conditioner (for example, JP 2015-140998 A). Such an indoor unit includes a casing and a heat exchanger disposed in the casing.

One end of a first refrigerant pipe is connected to the heat exchanger. One end of a second refrigerant pipe is connected to the other end of the first refrigerant pipe.

The first refrigerant pipe is formed of aluminum or an aluminum alloy. On the other hand, the second refrigerant pipe is formed of copper or a copper alloy.

SUMMARY

In one aspect, an indoor unit of the present disclosure includes:

a heat exchanger; and a connection pipe that is connected to the heat exchanger and through which a refrigerant flows, in which the connection pipe includes:

a first refrigerant pipe having one end connected to the heat exchanger, the first refrigerant pipe being formed of a first metal; and a second refrigerant pipe formed of a second metal having a smaller ionization tendency than an ionization tendency of the first metal of the first refrigerant pipe, the second refrigerant pipe having one end connected to the other end of the first refrigerant pipe, the first refrigerant pipe includes:

a vertical straight section extending along an approximate vertical direction, the vertical straight section having an end adjacent to the second refrigerant pipe;

a bent section that is continuous with the end of the vertical straight section and is bent, the bent section having an end adjacent to the second refrigerant pipe; and a horizontal straight section that is continuous with the end of the bent section and extends along an approximate horizontal direction, the horizontal straight section having an end adjacent to the second refrigerant pipe, and a covering member or a coating film is provided in intimate contact with (adheres to) the first refrigerant pipe to cover the first refrigerant pipe from the end of the horizontal straight section to the bent section.

Here, the portion adjacent to the second refrigerant pipe corresponds to a downstream portion in a direction of the flow of the refrigerant when the refrigerant flows from the first refrigerant pipe to the second refrigerant pipe, and corresponds to an upstream portion in a direction of the flow of the refrigerant when the refrigerant flows from the second refrigerant pipe to the first refrigerant pipe.

The approximate vertical direction means a vertical direction or a direction inclined at an angle of, for example, 20 degrees or less relative to the vertical direction.

The approximate horizontal direction means a horizontal direction or a direction inclined at an angle of, for example, 20 degrees or less relative to the horizontal direction.

Here, the portion adjacent to the first refrigerant pipe corresponds to an upstream portion in a direction of the flow of the refrigerant when the refrigerant flows from the first refrigerant pipe to the second refrigerant pipe, and corresponds to a downstream portion in a direction of the flow of the refrigerant when the refrigerant flows from the second refrigerant pipe to the first refrigerant pipe.

DESCRIPTION OF THE EMBODIMENTS

Figure 1:
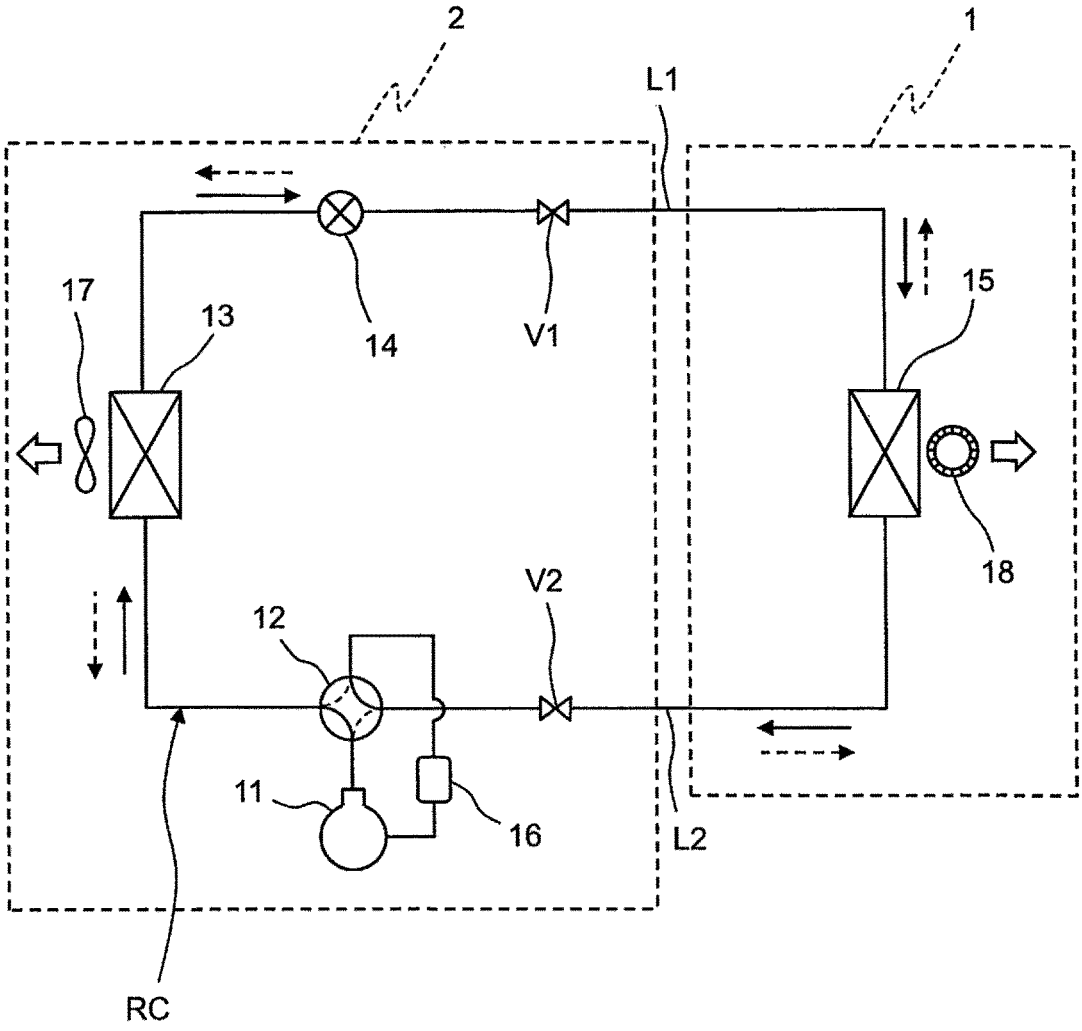
FIG. 1 is a refrigerant circuit diagram of an air conditioner of a first example of the present disclosure.

An indoor unit and an air conditioner of the present disclosure will be described in detail below with reference to embodiments illustrated in the drawings. Note that the same parts in the drawings are denoted by the same reference numerals to avoid the description from being redundant. Upper, lower, left, and right in the description correspond to upper, lower, left, and right in a state where an indoor unit is installed in a room.

First Example

FIG. 1 is a diagram illustrating a refrigerant circuit RC provided in an air conditioner of a first example of the present disclosure. This air conditioner is of a type in which an outdoor unit 2 is paired one-to-one with an indoor unit 1.

The air conditioner includes the indoor unit 1 and the outdoor unit 2 connected to the indoor unit 1 via the refrigerant circuit RC.

The refrigerant circuit RC includes a compressor 11, a four-way switching valve 12, an outdoor heat exchanger 13, an electric expansion valve 14, an indoor heat exchanger 15 as an example of a heat exchanger, and an accumulator 16. As the compressor 11 is driven, a refrigerant (for example, an HFC refrigerant such as R410A or R32) circulates in the refrigerant circuit RC.

More specifically, the four-way switching valve 12 has one end connected to a discharge-side portion of the compressor 11. The four-way switching valve 12 has the other end connected to one end of the outdoor heat exchanger 13. The outdoor heat exchanger 13 has the other end connected to one end of the electric expansion valve 14. The electric expansion valve 14 has the other end connected to one end of the indoor heat exchanger 15 via a shutoff valve V1 and a connection pipe L1. The indoor heat exchanger 15 has the other end connected to one end of the accumulator 16 via a connection pipe L2, a shutoff valve V2, and the four-way switching valve 12. The accumulator 16 has the other end connected to an intake-side portion of the compressor 11.

The indoor unit 1 is equipped with the indoor heat exchanger 15 and an indoor fan 18. The indoor fan 18 is, for example, a cross-flow fan, and takes in indoor air through the indoor heat exchanger 15.

The outdoor unit 2 is equipped with the compressor 11, the four-way switching valve 12, the outdoor heat exchanger 13, the electric expansion valve 14, the accumulator 16, and an outdoor fan 17.

The air conditioner switches the four-way switching valve 12 to a switching position indicated by a solid line to activate the compressor 11 for cooling operation and dehumidifying operation, and switches the four-way switching valve 12 to a switching position indicated by a dotted line to activate the compressor 11 for heating operation. A direction of a solid arrow in FIG. 1 indicates a direction in which the refrigerant flows during the cooling operation and the dehumidifying operation. A direction indicated by a dotted arrow in FIG. 1 indicates a direction in which the refrigerant flows during the heating operation.

Figure 2:
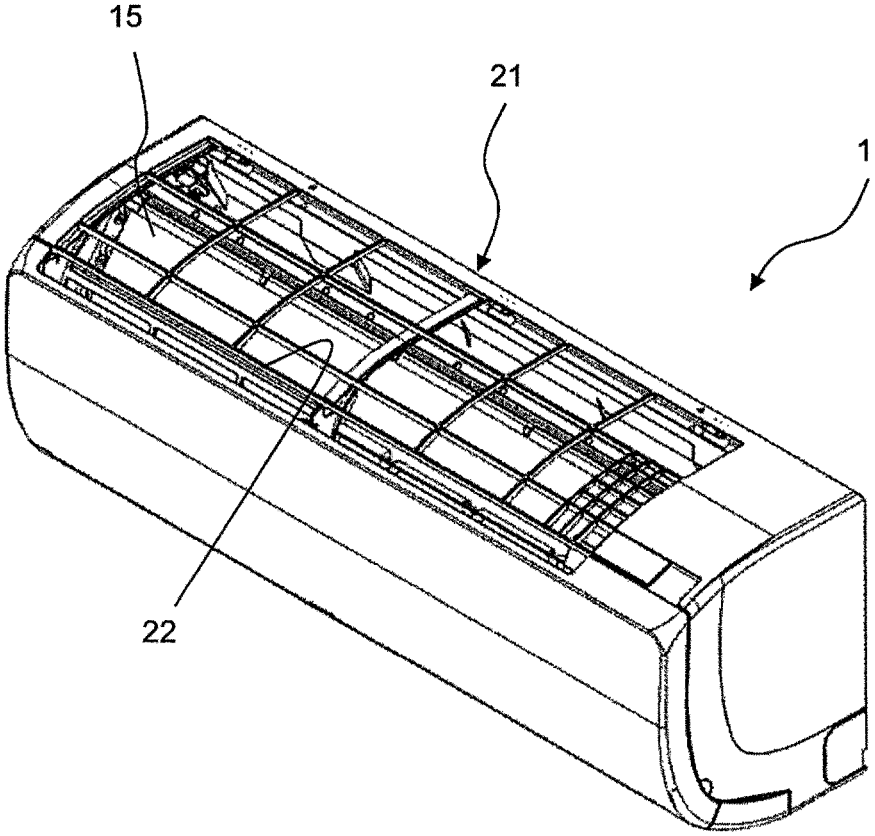
FIG. 2 is a perspective view of an indoor unit of the air conditioner of the first example.
Figure 3:
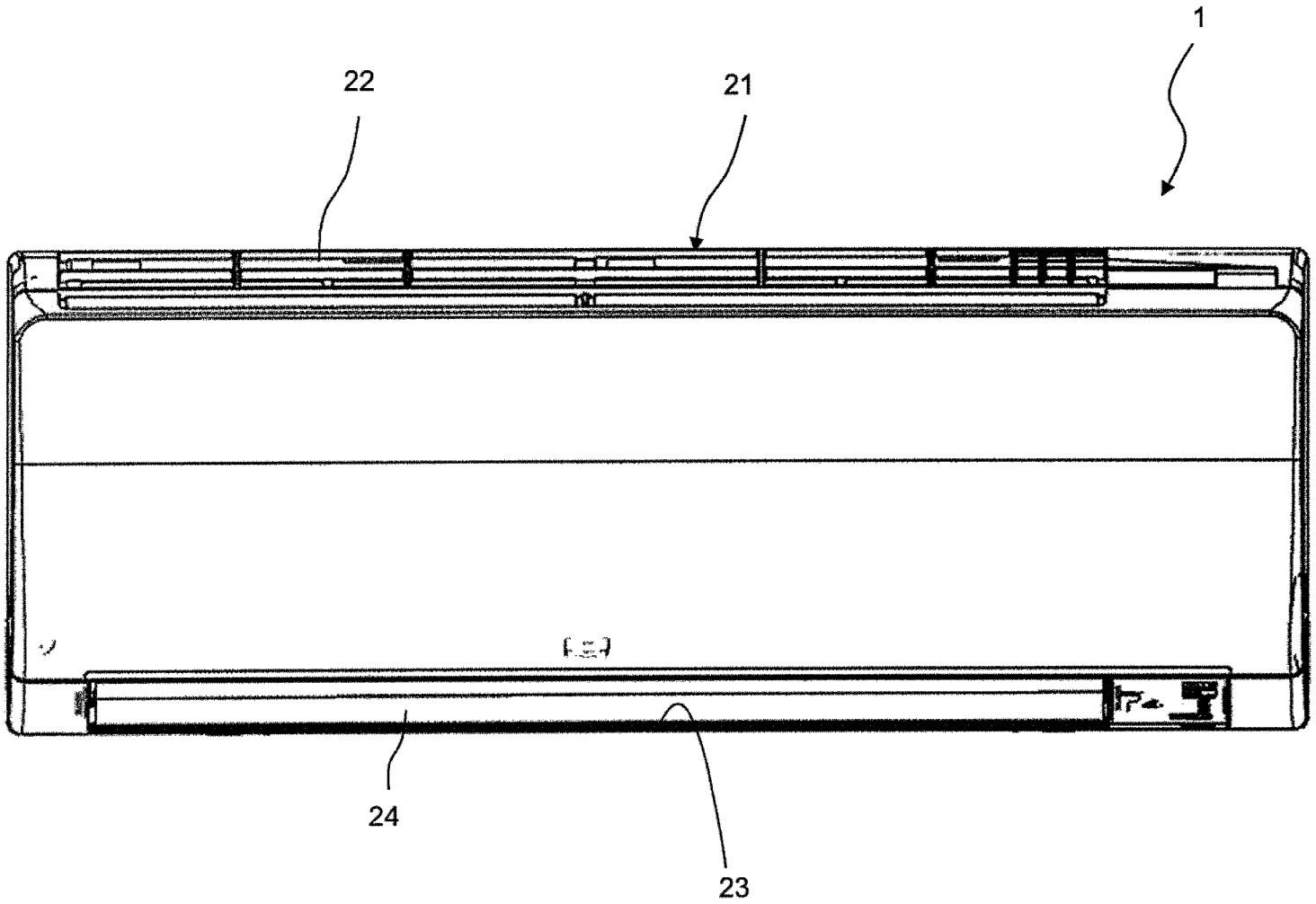
FIG. 3 is a front view of the indoor unit of the air conditioner of the first example.

FIG. 2 is a perspective view of the indoor unit 1 as viewed obliquely from above. FIG. 3 is a front view of the indoor unit 1.

As illustrated in FIGS. 2 and 3, the indoor unit 1 includes a casing 21, and the indoor heat exchanger 15, the indoor fan 18, and the like are accommodated in the casing 21.

An upper portion of the casing 21 is provided with an intake port 22 through which indoor air is taken in. When the indoor fan 18 is driven, indoor air enters the casing 21 through the intake port 22 and flows toward the indoor fan 18. At this time, in order to prevent dust and the like from entering the casing 21 together with indoor air, a filter (not illustrated) is attached to the intake port 22.

A lower portion of the casing 21 is provided with a blow-out port 23 through which air from the indoor fan 18 (indoor air subjected to heat exchange with the indoor heat exchanger 15) blows out. A horizontal flap 24 is rotatably attached to a peripheral edge portion of the blow-out port 23.

When the cooling operation or the like is started, the horizontal flap 24 changes its position from a stop position to close the blow-out port 23 to an operation position to open the blow-out port 23 to adjust a vertical airflow direction of air blown out from the blow-out port 23.

Figure 4:
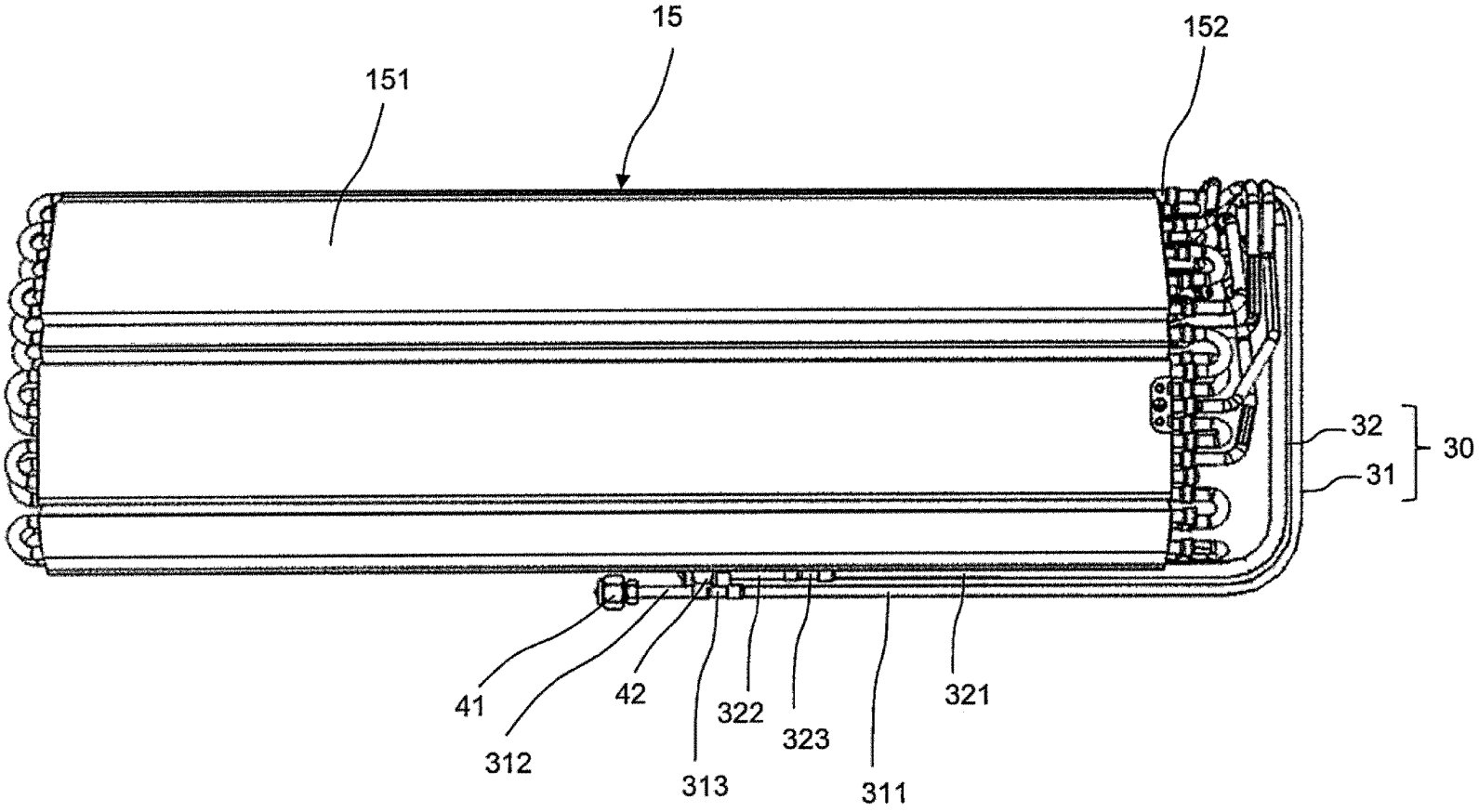
FIG. 4 is a front view of an indoor heat exchanger of the first example and a peripheral portion of the indoor heat exchanger.

FIG. 4 is a front view of the indoor heat exchanger 15 and a peripheral portion of the indoor heat exchanger 15.

The indoor heat exchanger 15 includes a heat exchange portion 151 and a plurality of heat transfer tubes 152 extending through the heat exchange portion 151 in a left-right direction. The heat exchange portion 151 and the heat transfer tubes 152 are each formed of aluminum or an aluminum alloy.

The indoor unit 1 further includes a connection pipe 30 that is fluidly connected to the heat transfer tubes 152 of the indoor heat exchanger 15 and through which the refrigerant flows.

The connection pipe 30 includes a liquid-refrigerant connection pipe 31 constituting a part of the connection pipe L1 and a gas-refrigerant connection pipe 32 constituting a part of the connection pipe L2. The liquid-refrigerant connection pipe 31 guides a liquid refrigerant from the electric expansion valve 14 to the indoor heat exchanger 15 during the cooling operation and the dehumidifying operation. On the other hand, the gas-refrigerant connection pipe 32 guides a gas refrigerant from the indoor heat exchanger 15 to the compressor 11 during the cooling operation and the dehumidifying operation. The liquid-refrigerant connection pipe 31 and the gas-refrigerant connection pipe 32 are each an example of the connection pipe.

<Configuration of Liquid-Refrigerant Connection Pipe 31>

The liquid-refrigerant connection pipe 31 has includes a first liquid-refrigerant pipe 311 formed of aluminum or an aluminum alloy, and a second liquid-refrigerant pipe 312 formed of copper or a copper alloy. The first liquid-refrigerant pipe 311 has one end fluidly connected to the heat transfer tubes 152 of the indoor heat exchanger 15. The first liquid-refrigerant pipe 311 is an example of a first refrigerant pipe. The aluminum and the aluminum alloy are each an example of a first metal. The second liquid-refrigerant pipe 312 is an example of a second refrigerant pipe. The copper and the copper alloy are each an example of a second metal.

The second liquid-refrigerant pipe 312 has one end fluidly connected to the other end of the first liquid-refrigerant pipe 311 through a third liquid-refrigerant pipe 313 formed of stainless steel. On the other hand, the second liquid-refrigerant pipe 312 has the other end fixed to a liquid-refrigerant flare union 41 by brazing. The third liquid-refrigerant pipe 313 is an example of a third refrigerant pipe (a stainless steel refrigerant pipe).

The third liquid-refrigerant pipe 313 has one end and the other end that is larger in outer diameter than the one end. The third liquid-refrigerant pipe 313 has the one end connected to an end of the first liquid-refrigerant pipe 311 adjacent to the third liquid-refrigerant pipe 313. On the other hand, the third liquid-refrigerant pipe 313 has the other end connected to an end of the second liquid-refrigerant pipe 312 adjacent to the third liquid-refrigerant pipe 313.

More specifically, the end of the third liquid-refrigerant pipe 313 adjacent to the first liquid-refrigerant pipe 311 is not enlarged in diameter, is inserted into the end of the first liquid-refrigerant pipe 311 adjacent to the third liquid-refrigerant pipe 313, and is fixed to the first liquid-refrigerant pipe 311 by brazing. The end of the third liquid-refrigerant pipe 313 adjacent to the second liquid-refrigerant pipe 312 is enlarged in diameter, into which the end of the second liquid-refrigerant pipe 312 adjacent to the third liquid-refrigerant pipe 313 is inserted, and is fixed to the second liquid-refrigerant pipe 312 by brazing.

The end of the first liquid-refrigerant pipe 311 adjacent to the third liquid-refrigerant pipe 313 is enlarged in diameter in a manner similar to the end of the third liquid-refrigerant pipe 313 adjacent to the second liquid-refrigerant pipe 312 to be larger in outer diameter than the other portion of the first liquid-refrigerant pipe 311.

<Configuration of Gas-Refrigerant Connection Pipe 32>

The gas-refrigerant connection pipe 32 is similar in configuration to the liquid-refrigerant connection pipe 31, and includes a first gas-refrigerant pipe 321 formed of aluminum or an aluminum alloy, and a second gas-refrigerant pipe 322 formed of copper or a copper alloy. The first gas-refrigerant pipe 321 is an example of the first refrigerant pipe. The second gas-refrigerant pipe 322 is an example of the second refrigerant pipe.

The first gas-refrigerant pipe 321 has one end fluidly connected to the heat transfer tubes 152 of the indoor heat exchanger 15.

The second gas-refrigerant pipe 322 has one end fluidly connected to the other end of the first gas-refrigerant pipe 321 through a third gas-refrigerant pipe 323 formed of stainless steel. On the other hand, the second gas-refrigerant pipe 322 has the other end fixed to a gas-refrigerant flare union 42 by brazing.

Figure 5:
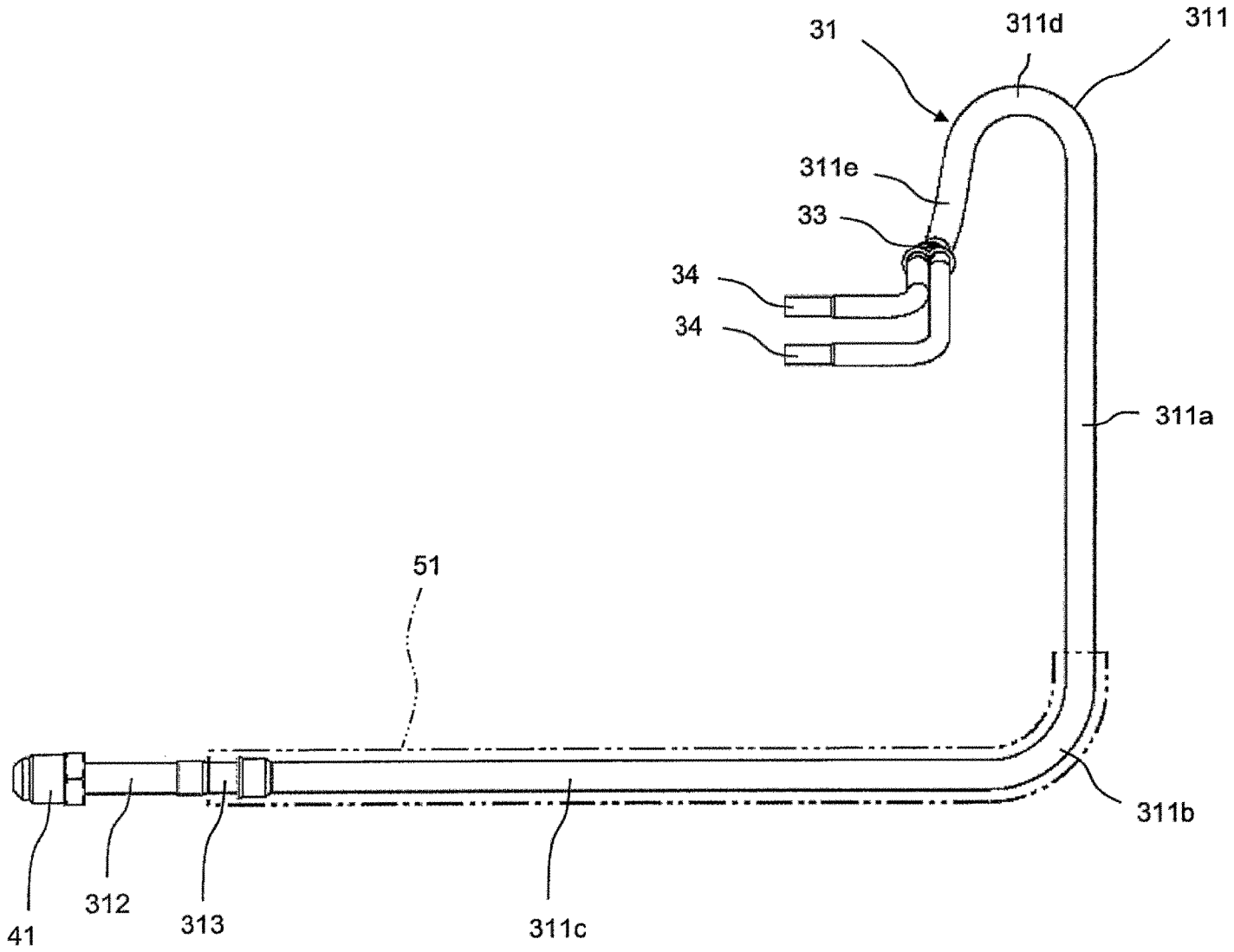
FIG. 5 is a front view of a liquid-refrigerant connection pipe of the first example and a peripheral portion of the liquid-refrigerant connection pipe.
Figure 6:
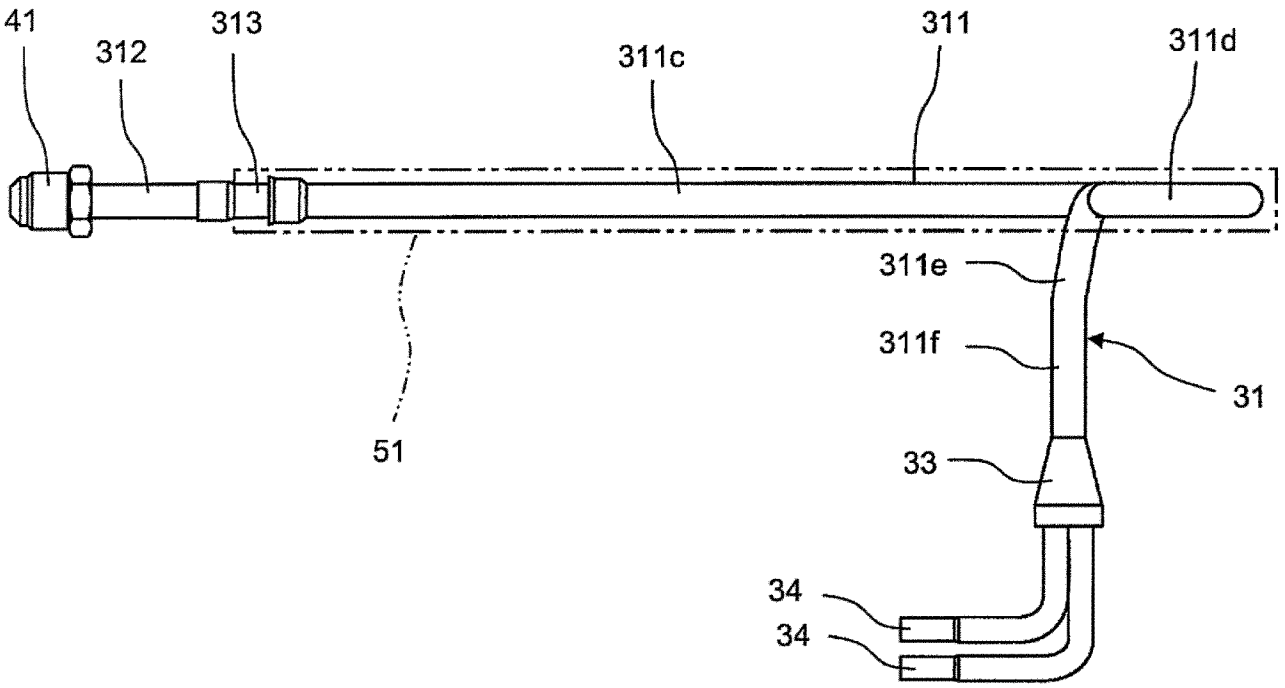
FIG. 6 is a top view of the liquid-refrigerant connection pipe of the first example and the peripheral portion of liquid-refrigerant connection pipe.
Figure 7:
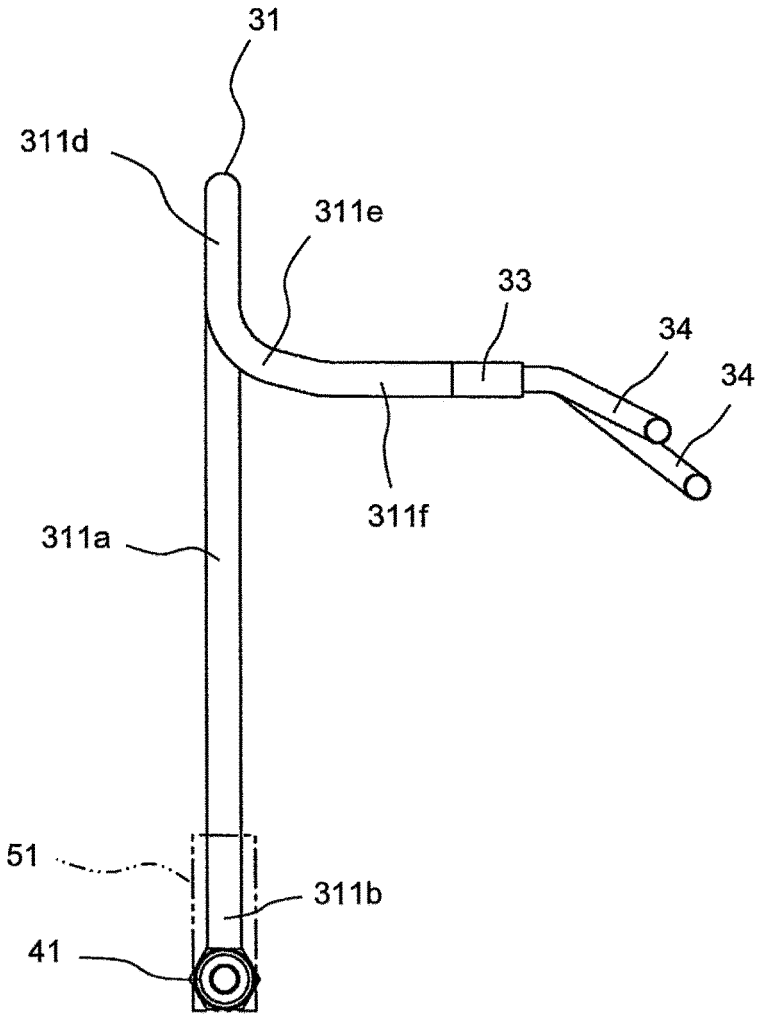
FIG. 7 is a left-side view of the liquid-refrigerant connection pipe of the first example and the peripheral portion of liquid-refrigerant connection pipe.

FIG. 5 is a front view of the liquid-refrigerant connection pipe 31 and a peripheral portion of the liquid-refrigerant connection pipe 31. FIG. 6 is a top view of the liquid-refrigerant connection pipe 31 and the peripheral portion of the liquid-refrigerant connection pipe 31. FIG. 7 is a left-side view of the liquid-refrigerant connection pipe 31 and the peripheral portion of the liquid-refrigerant connection pipe 31.

The first liquid-refrigerant pipe 311 of the liquid-refrigerant connection pipe 31 includes a vertical straight section 311*a* extending along an approximate vertical direction. The approximate vertical direction refers to a vertical direction or refers to a direction inclined at an angle of, for example, 20 degrees or less relative to the vertical direction.

<Configuration of First Liquid-Refrigerant Pipe 311 Adjacent to Second Liquid-Refrigerant Pipe 312>

The first liquid-refrigerant pipe 311 includes a bent section 311*b* formed integrally with the vertical straight section 311*a*, i.e., seamlessly with the vertical straight section 311*a*. The bent section 311*b* is located adjacent to the second liquid-refrigerant pipe 312 relative to the vertical straight section 311*a*. That is, the bent section 311*b* is positioned closer to the second liquid-refrigerant pipe 312 than the vertical straight section 311*a*. The bent section 311*b* is continuous with a lower end of the vertical straight section 311*a* and is bent from the lower end toward the second liquid-refrigerant pipe 312. The lower end of the vertical straight section 311*a* corresponds to an end of the vertical straight section 311*a* adjacent to the second liquid-refrigerant pipe 312 (i.e., an end on the second liquid-refrigerant pipe side).

The first liquid-refrigerant pipe 311 further includes a horizontal straight section 311*c* formed integrally with the bent section 311*b*, i.e., seamlessly with the bent section 311*b*. The horizontal straight section 311*c* is located adjacent to the second liquid-refrigerant pipe 312 relative to the bent section 311*b*. That is, the horizontal straight section 311*c* is positioned closer to the second liquid-refrigerant pipe 312 than the bent section 311*b*. The horizontal straight section 311*c* is continuous with an end of the bent section 311*b* adjacent to the second liquid-refrigerant pipe 312 (i.e., an end on the second liquid-refrigerant pipe side) and extends along an approximate horizontal direction. The approximate horizontal direction refers to a horizontal direction or a direction inclined at an angle of, for example, 20 degrees or less relative to the horizontal direction.

The first liquid-refrigerant pipe 311 has an outer peripheral surface extending from an end of the horizontal straight section 311*c* adjacent to the second liquid-refrigerant pipe 312 (i.e., an end on the second liquid-refrigerant pipe side) to an end of the bent section 311*b* adjacent to the vertical straight section 311*a*, the outer peripheral surface being entirely covered with a waterproof tube 51. The waterproof tube 51 is formed of a tube made of a waterproof material (for example, vinyl chloride, silicone rubber, fluorine-based polymer, or the like) and shrunk by heating. Accordingly, the waterproof tube 51 is in intimate contact with the outer peripheral surfaces of the bent section 311*b* and the horizontal straight section 311*c*. The waterproof tube 51 is an example of a covering member.

The waterproof tube 51 is also in intimate contact with an outer peripheral surface of the end of the third liquid-refrigerant pipe 313 adjacent to the first liquid-refrigerant pipe 311 to cover the entire circumference of the end.

<Configuration of First Liquid-Refrigerant Pipe 311 Adjacent to Indoor Heat Exchanger 15>

The first liquid-refrigerant pipe 311 includes a curved section 311*d* formed integrally with the vertical straight section 311*a*, i.e., seamlessly with the vertical straight section 311*a*. The curved section 311*d* is located adjacent to the indoor heat exchanger 15 relative to the vertical straight section 311*a*. That is, the curved section 311*d* is positioned closer to the indoor heat exchanger 15 than the vertical straight section 311*a*. A lower right end of the curved section 311*d* is continuous with an upper end of the vertical straight section 311*a*. The curved section 311*d* has a shape curved from the upper end of the vertical straight section 311*a* toward the indoor heat exchanger 15 like a U-turn. The lower right end of the curved section 311*d* corresponds to an end of the curved section 311*d* adjacent to the second liquid-refrigerant pipe 312. The upper end of the vertical straight section 311*a* corresponds to an end of the vertical straight section 311*a* adjacent to the indoor heat exchanger 15.

The first liquid-refrigerant pipe 311 includes a bent connecting section 311*e* formed integrally with the curved section 311*d*, i.e., seamlessly with the curved section 311*d*. The bent connecting section 311*e* is located adjacent to the indoor heat exchanger 15 relative to the curved section 311*d*. That is, the bent connecting section 311*e* is positioned closer to the indoor heat exchanger 15 than the curved section 311*d*. The bent connecting section 311*e* is continuous with a lower left end of the curved section 311*d* and is bent from the lower left end toward a flow divider 33. The lower left end of the curved section 311*d* corresponds to an end of the curved section 311*d* adjacent to the indoor heat exchanger 15.

The first liquid-refrigerant pipe 311 includes a straight connecting section 311*f* formed integrally with the bent connecting section 311*e*, i.e., seamlessly with the bent connecting section 311*e*. The straight connecting section 311*f* is located adjacent to the indoor heat exchanger 15 relative to the bent connecting section 311*e*. That is, the straight connecting section 311*f* is positioned closer to the indoor heat exchanger 15 than the bent connecting section 311*e*. The straight connecting section 311*f* extends from an end of the bent connecting section 311*e* adjacent to the indoor heat exchanger 15 to the flow divider 33.

The flow divider 33 is formed of aluminum or an aluminum alloy. A branch pipe 34 formed of aluminum or an aluminum alloy is fixed to an end of the flow divider 33 adjacent to the indoor heat exchanger 15 by brazing.

In the air conditioner configured as described above, the outer peripheral surfaces of the bent section 311*b* and the horizontal straight section 311*c* of the first liquid-refrigerant pipe 311 are entirely covered with the waterproof tube 51. Accordingly, for example, even when dew condensation water containing copper ions flows from the second liquid-refrigerant pipe 312 toward the first liquid-refrigerant pipe 311, it is possible to prevent dew condensation water from adhering to the bent section 311*b* and the horizontal straight section 311*c* of the first liquid-refrigerant pipe 311. In short, the waterproof tube 51 can reduce the possibility that dew condensation water containing copper ions adheres to the bent section 311*b* and the horizontal straight section 311*c* of the first liquid-refrigerant pipe 311. It is therefore possible to prevent the first liquid-refrigerant pipe 311 from suffering electrolytic corrosion.

Since the waterproof tube 51 is in intimate contact with the outer peripheral surface of the first liquid-refrigerant pipe 311, it is possible to reduce the possibility that liquid such as dew condensation water enters a space between the waterproof tube 51 and the first liquid-refrigerant pipe 311. It is therefore possible to enhance the effect of preventing the first liquid-refrigerant pipe 311 from suffering electrolytic corrosion.

Since the waterproof tube 51 further covers the outer peripheral surface of the end of the third liquid-refrigerant pipe 313 adjacent to the first liquid-refrigerant pipe 311, it is possible to reduce the possibility that liquid enters the space between the first liquid-refrigerant pipe 311 and the waterproof tube 51 from the other end of the first liquid-refrigerant pipe 311. It is therefore possible to enhance the effect of preventing the first liquid-refrigerant pipe 311 from suffering electrolytic corrosion.

Since the waterproof tube 51 is formed so as not to cover the vertical straight section 311*a* of the first liquid-refrigerant pipe 311, the waterproof tube 51 can be made short in an axial direction as compared with a case where the waterproof tube 51 is formed so as to cover the vertical straight section 311*a* of the first liquid-refrigerant pipe 311. It is therefore possible to suppress an increase in manufacturing cost of the waterproof tube 51.

Even if liquid such as dew condensation water adheres to the vertical straight section 311*a* of the first liquid-refrigerant pipe 311, the liquid flows down toward the bent section 311*b* because the vertical straight section 311*a* extends in the approximate vertical direction. Therefore, even if the outer peripheral surface of the vertical straight section 311*a* of the first liquid-refrigerant pipe 311 is not covered with the waterproof tube 51, the risk of causing the vertical straight section 311*a* to suffer electrolytic corrosion is low.

In the air conditioner of the first example, one indoor unit 1 is connected to one outdoor unit 2, or alternatively, a plurality of indoor units 1 may be connected. In other words, the above-described air conditioner is of a pair-type, or alternatively, the air conditioner may be of a multi-type.

The first liquid-refrigerant pipe 311 is formed of aluminum or an aluminum alloy in the first example, or alternatively, may be formed of metal other than aluminum and an aluminum alloy. Also in this case, the metal of which the first liquid-refrigerant pipe 311 is formed is selected so as to be lower in potential than the metal of which the second liquid-refrigerant pipe 312 is formed.

The second liquid-refrigerant pipe 312 is formed of copper or a copper alloy in the first example, or alternatively, may be formed of metal other than copper or a copper alloy. Also in this case, the metal of which the second liquid-refrigerant pipe 312 is formed is selected so as to be higher in potential than the metal of which the first liquid-refrigerant pipe 311 is formed.

The first gas-refrigerant pipe 321 is formed of aluminum or an aluminum alloy in the first example, or alternatively, may be formed of metal other than aluminum and an aluminum alloy. Also in this case, the metal of which the first gas-refrigerant pipe 321 is formed is selected so as to be lower in potential than the metal of which the second gas-refrigerant pipe 322 is formed.

The second gas-refrigerant pipe 322 is formed of copper or a copper alloy in the first example, or alternatively, may be formed of metal other than copper or a copper alloy. Also in this case, the metal of which the second gas-refrigerant pipe 322 is formed is selected so as to be higher in potential than the metal of which the first gas-refrigerant pipe 321 is formed.

The flow divider 33 and the branch pipe 34 are interposed between the heat transfer tubes 152 of the indoor heat exchanger 15 and the one end of the first liquid-refrigerant pipe 311 in the first example, or alternatively, the flow divider 33 and the branch pipe 34 need not be interposed. In other words, the one end of the first liquid-refrigerant pipe 311 may be directly connected to the heat transfer tubes 152 of the indoor heat exchanger 15.

The flow divider 33 that divides one refrigerant flow into two refrigerant flows is used in the first example, or alternatively, a flow divider 33 that divides one refrigerant flow into three or more refrigerant flows may be used.

The third liquid-refrigerant pipe 313 is interposed between the other end of the first liquid-refrigerant pipe 311 and one end of the second liquid-refrigerant pipe 312 in the first example, or alternatively, the third liquid-refrigerant pipe 313 need not be interposed. In other words, for example, the second liquid-refrigerant pipe 312 may have one end directly connected to the other end of the first liquid-refrigerant pipe 311.

The waterproof tube 51 is provided on the liquid-refrigerant connection pipe 31 in the first example, or alternatively, may be provided on the gas-refrigerant connection pipe 32 in a manner similar to the case where waterproof tube 51 is provided on the liquid-refrigerant connection pipe 31.

The waterproof tube 51 covers the entire outer peripheral surface of the bent section 311*b* in the first example, or alternatively, may cover only the outer peripheral surface of the end of the bent section 311*b* adjacent to the horizontal straight section 311*c* and need not cover the outer peripheral surface of the other part of the bent section 311*b*.

The waterproof tube 51 is formed so as not to cover the outer peripheral surface of the end of the third liquid-refrigerant pipe 313 adjacent to the second liquid-refrigerant pipe 312 in the first example, or alternatively, may be formed so as to cover the outer peripheral surface of the end of the third liquid-refrigerant pipe 313 adjacent to the second liquid-refrigerant pipe 312. In other words, for example, the waterproof tube 51 may be formed so as to cover the entire outer peripheral surface of the third liquid-refrigerant pipe 313.

The outer peripheral surfaces of the bent section 311*b* and the horizontal straight section 311*c* of the first liquid-refrigerant pipe 311 is covered with the waterproof tube 51 in the first example, or alternatively, the outer peripheral surfaces of the bent section 311*b* and the horizontal straight section 311*c* of the first liquid-refrigerant pipe 311 may be covered with a coating film. The coating film is made of a waterproof material (for example, fluororesin, fiber reinforced plastic (FRP), acrylic rubber, or the like). For example, the material may have heat resistance or elasticity.

For example, the coating film may be formed so as not to cover the outer peripheral surface of the third liquid-refrigerant pipe 313 or so as to cover the outer peripheral surface of the third liquid-refrigerant pipe 313. In a case where the outer peripheral surface of the third liquid-refrigerant pipe 313 is covered with the coating film, at least a connection point between the first liquid-refrigerant pipe 311 and the third liquid-refrigerant pipe 313 needs to be covered with the coating film.

Second Example

Figure 8:
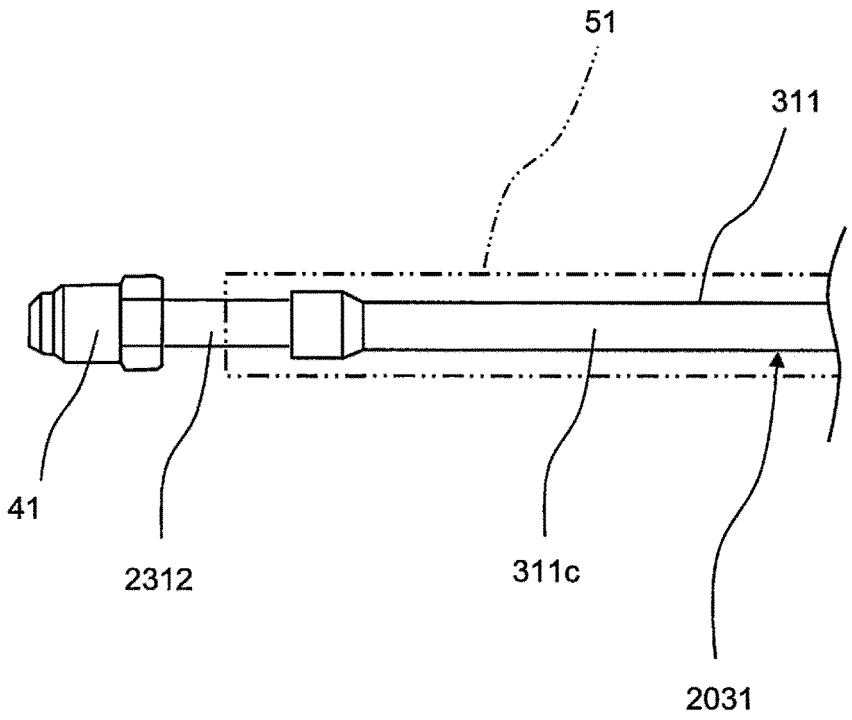
FIG. 8 is an enlarged view of a main portion of a liquid-refrigerant connection pipe of a second example of the present disclosure.

FIG. 8 is an enlarged view of a main portion of a liquid-refrigerant connection pipe 2031 of an air conditioner of a second example of the present disclosure. The air conditioner of the second example is similar in configuration to the air conditioner of the first example except for a configuration between the other end of the first liquid-refrigerant pipe 311 and the liquid-refrigerant flare union 41.

In the air conditioner of the second example, the liquid-refrigerant connection pipe 2031 includes a second liquid-refrigerant pipe 2312 formed of stainless steel. The second liquid-refrigerant pipe 2312 has one end fluidly connected to the other end of the first liquid-refrigerant pipe 311 without the third liquid-refrigerant pipe 313. The second liquid-refrigerant pipe 2312 is an example of the second refrigerant pipe.

The waterproof tube 51 is in intimate contact with an outer peripheral surface of the end of the second liquid-refrigerant pipe 2312 adjacent to the first liquid-refrigerant pipe 311 to cover the entire circumference of the end.

In the air conditioner configured as described above, since the third liquid-refrigerant pipe 313 is not interposed between the first liquid-refrigerant pipe 311 and the second liquid-refrigerant pipe 2312, it is possible to reduce the number of components. It is therefore possible to simplify a process of manufacturing the air conditioner.

Since the second liquid-refrigerant pipe 2312 is formed of stainless steel, it is possible to inhibit the progression on rust of the second liquid-refrigerant pipe 2312.

Since the waterproof tube 51 further covers the outer peripheral surface of the end of the second liquid-refrigerant pipe 2312 adjacent to the first liquid-refrigerant pipe 311, it is possible to reduce the possibility that liquid enters the space between the first liquid-refrigerant pipe 311 and the waterproof tube 51 from the other end of the first liquid-refrigerant pipe 311. It is therefore possible to enhance the effect of preventing the first liquid-refrigerant pipe 311 from suffering electrolytic corrosion.

Third Example

Figure 9:
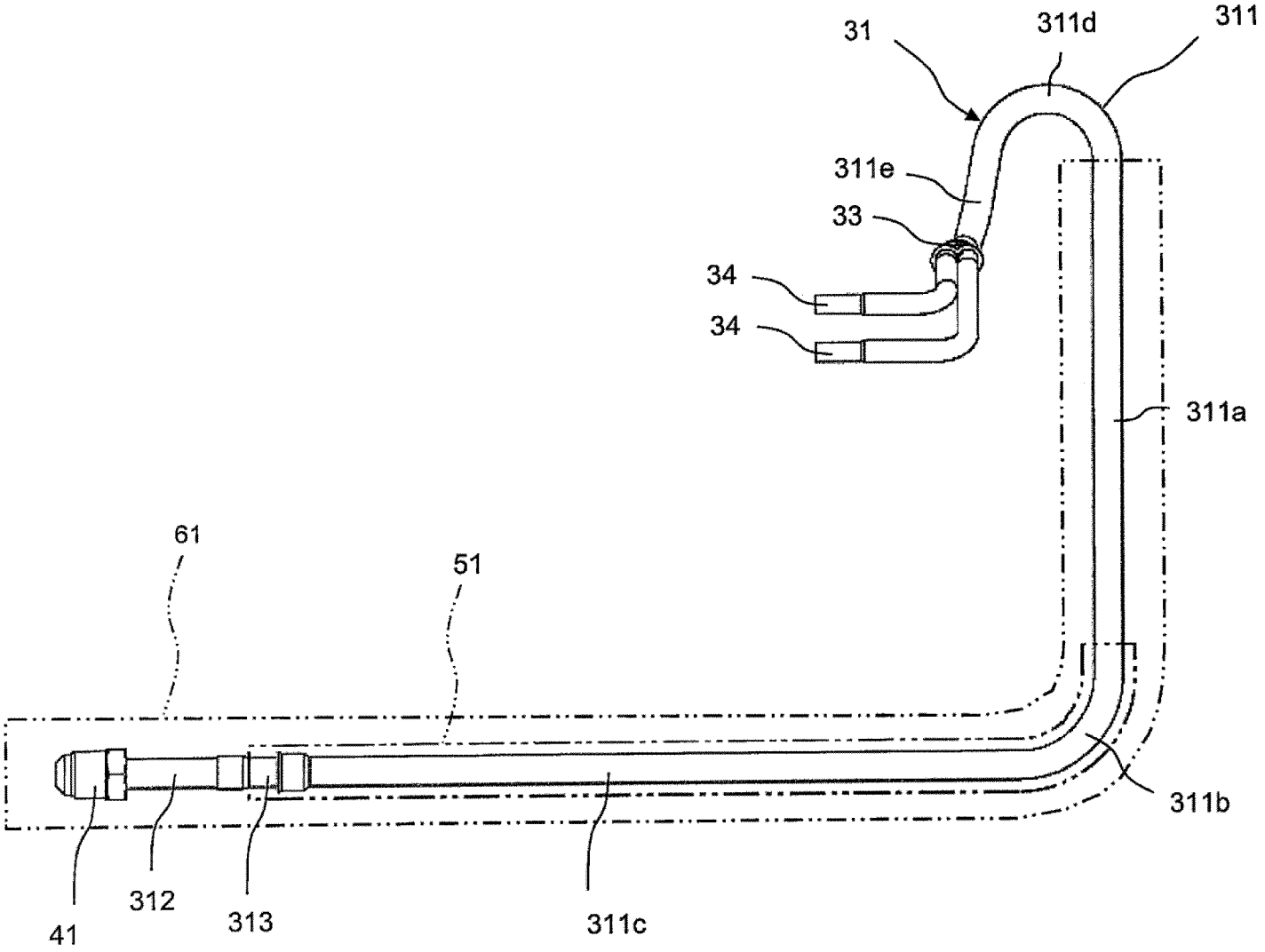
FIG. 9 is a front view of a liquid-refrigerant connection pipe of a third example of the present disclosure and a peripheral portion of the liquid-refrigerant connection pipe.

FIG. 9 is a front view of a liquid-refrigerant connection pipe 31 of an air conditioner of a third example of the present disclosure and a peripheral portion of the liquid-refrigerant connection pipe 31.

The air conditioner of the third example is similar in configuration to the air conditioner of the first example except that a tubular member 61 covering the waterproof tube 51 is provided.

The tubular member 61 is formed of a heat insulating material (for example, foamed polyester). The tubular member 61 covers the first liquid-refrigerant pipe 311 from the upper end of the vertical straight section 311*a* to a tip of the liquid refrigerant union.

Although not illustrated, most of the gas-refrigerant connection pipe 32 is inserted into the tubular member 61 in a manner similar to the liquid-refrigerant connection pipe 31. Therefore, the tubular member 61 has an inner diameter set larger than a sum of an outer diameter of the liquid-refrigerant connection pipe 31 and an outer diameter of the gas-refrigerant connection pipe 32.

In the air conditioner configured as described above, since the tubular member 61 covers the waterproof tube 51, it is possible to prevent liquid such as dew condensation water from adhering to the covering member or the waterproof tube 51. It is therefore possible to prevent, even if the waterproof tube 51 becomes cracked, the first liquid-refrigerant pipe 311 from suffering electrolytic corrosion.

Fourth Example

Figure 10:
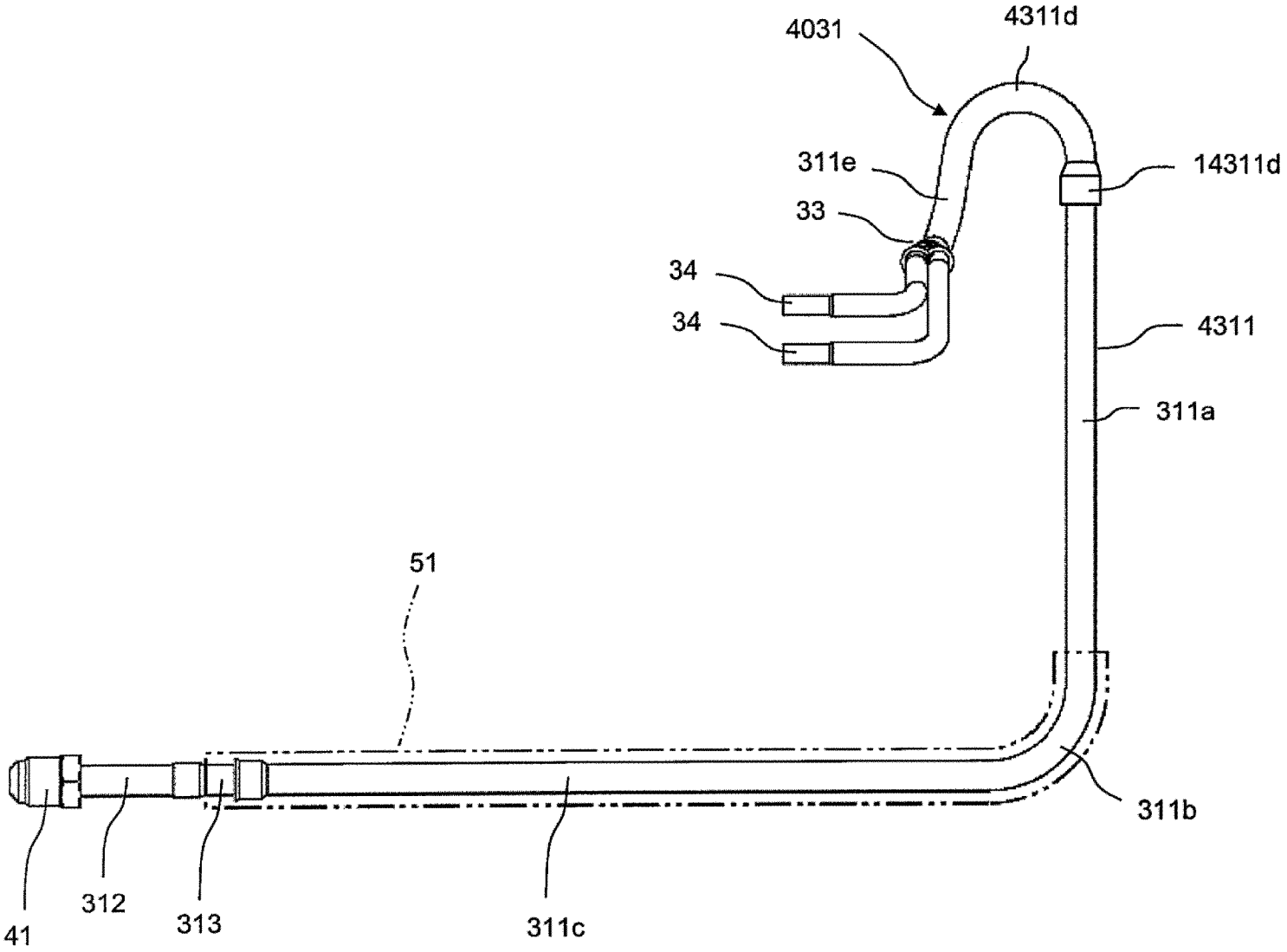
FIG. 10 is a front view of a liquid-refrigerant connection pipe of a fourth example of the present disclosure and a peripheral portion of the liquid-refrigerant connection pipe.

FIG. 10 is a front view of a liquid-refrigerant connection pipe 4031 of an air conditioner of a fourth example of the present disclosure and a peripheral portion of the liquid-refrigerant connection pipe 4031.

The air conditioner of the fourth example is similar in configuration to the air conditioner of the first example except that the liquid-refrigerant connection pipe 4031 formed of aluminum or an aluminum alloy is provided. The liquid-refrigerant connection pipe 4031 is an example of the connection pipe.

The liquid-refrigerant connection pipe 4031 includes a first liquid-refrigerant pipe 4311 formed of two pipe members joined together.

More specifically, the first liquid-refrigerant pipe 4311 includes a curved section 4311*d* located between the indoor heat exchanger 15 and the vertical straight section 311*a*. A joint portion 14311*d* of the curved section 4311*d* is an end of the curved section 4311*d* adjacent to the second liquid-refrigerant pipe 312 and is a portion of the curved section 4311*d* enlarged in diameter. The upper end of the vertical straight section 311*a* is inserted into and fixed to the joint portion 14311*d* by brazing.

In the air conditioner configured as described above, since the liquid-refrigerant connection pipe 4031 is provided with the joint portion 14311*d*, it is possible to insert the upper end of the vertical straight section 311*a* into the waterproof tube 51 before the upper end of the vertical straight section 311*a* is brazed to the joint portion 14311*d* and before the waterproof tube 51 is subjected to heat shrinkage. It is therefore possible to make the attachment of the waterproof tube 51 easy.

The joint portion 14311*d* is provided at the end of the curved section 4311*d* adjacent to the second liquid-refrigerant pipe 312 in the fourth example, or alternatively, may be provided not at the end of the curved section 4311*d* adjacent to the second liquid-refrigerant pipe 312 but at the upper end of the vertical straight section 311*a*.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1 indoor unit
15 indoor heat exchanger
31, 2031 liquid-refrigerant connection pipe

32 gas-refrigerant connection pipe
33 flow divider
41 liquid-refrigerant flare union
42 gas-refrigerant flare union
51 waterproof tube
61 tubular member
151 heat exchange portion
152 heat transfer tube
311, 4311 first liquid-refrigerant pipe
311*a* vertical straight section
311*b* bent section
311*c* horizontal straight section
311*d*, 4311*d* curved section
311*e* bent connecting section
311*f* straight connecting section
312, 2312 second liquid-refrigerant pipe
313 third liquid-refrigerant pipe
321 first gas-refrigerant pipe
322 second gas-refrigerant pipe
14311*d* joint portion

What is claimed is:

1. An indoor unit comprising:

a heat exchanger; and a connection pipe, connected to the heat exchanger, through which a refrigerant flows, wherein the connection pipe includes a first refrigerant pipe made of a first metal and a second refrigerant pipe made of a second metal higher in potential than the first metal, one end of the first refrigerant pipe is connected to the heat exchanger, and the other end of the first refrigerant pipe is connected to one end of the second refrigerant pipe, the first refrigerant pipe includes:

a vertical straight section that extends along an approximate vertical direction;

a bent section that is continuous with and connected to a one end of the vertical straight section on a second refrigerant pipe side; and a horizontal straight section that extends along an approximate horizontal direction and that is continuous with and connected to one end of the bent section that is on the second refrigerant pipe side, and a tube or a coating film adheres to and covers the first refrigerant pipe from one end of the horizontal straight section that is on the second refrigerant pipe side to the bent section such that the tube or the coating film prevents dew condensation water containing copper ions from adhering to the bent section and the horizontal straight section.

2. The indoor unit according to claim 1, wherein the tube or the coating film covers the one end of the second refrigerant pipe that is connected to the other end of the first refrigerant pipe.

3. The indoor unit according to claim 1, wherein the second refrigerant pipe is connected to the other end of the first refrigerant pipe through a stainless steel refrigerant pipe, and the tube or the coating film covers the stainless steel refrigerant pipe.

4. The indoor unit according to claim 1, wherein the tube or the coating film is covered with a tubular member made of a heat insulating material.

5. The indoor unit according to claim 1, wherein the first refrigerant pipe further includes a curved section disposed between the heat exchanger and the vertical straight section, and the vertical straight section is connected to the curved section through a joint portion.

6. An air conditioner comprising the indoor unit according to claim 1.

* * * * *